United States Patent [19]

Herber et al.

[11] 3,976,585

[45] Aug. 24, 1976

[54] FUNCTIONAL FLUID COMPOSITIONS CONTAINING EPOXIDE STABILIZERS

[75] Inventors: John F. Herber, St. Louis; Robert W. Street; William R. Richard, Jr., both of Kirkwood, all of Mo.

[73] Assignee: Monsanto Company, St. Louis, Mo.

[22] Filed: Mar. 25, 1974

[21] Appl. No.: 454,538

[52] U.S. Cl. ..... 252/78.5; 252/49.8; 252/78.1; 252/49.9; 252/56 S; 252/57; 252/79; 252/396; 252/407; 260/348 C

[51] Int. Cl.[2] ..... C10M 3/40; C10M 3/20

[58] Field of Search ..... 252/78, 79, 73, 49.8, 252/56 S, 57, 49.9, 396, 407; 260/348 C

[56] References Cited

UNITED STATES PATENTS

| | | | |
|---|---|---|---|
| 2,862,886 | 12/1958 | Davies et al. | 252/78 |
| 3,487,020 | 12/1969 | Peeler | 252/78 |
| 3,637,507 | 1/1972 | Gentit | 252/78 |
| 3,723,320 | 3/1973 | Herber et al. | 252/78 |

*Primary Examiner*—Harris A. Pitlick
*Attorney, Agent, or Firm*—Herbert B. Roberts

[57] ABSTRACT

Functional fluid compositions comprising a major amount of a base stock material which is an ester or amide of an acid phosphorus, a di- or tricarboxylic acid ester, an ester of a polyhydric compound or mixtures thereof, optionally minor amounts of other base stock materials or base stock modifiers such as viscosity index improvers, cavitation damage inhibitors, and lubricity agents, and an additive amount of an acid scavenger and corrosion inhibitor which is a monoepoxy substituted cyclohexane such as $C_{1-4}$ alkyl-3,4-epoxycyclohexane. The compositions are particularly useful as aircraft hydraulic fluids.

12 Claims, No Drawings

FUNCTIONAL FLUID COMPOSITIONS CONTAINING EPOXIDE STABILIZERS

BACKGROUND OF THE INVENTION

1. Field of the Invention

This invention relates to functional fluid compositions, particularly hydraulic fluids and to monoepoxycyclohexyl compounds which are effective to inhibit acid buildup in such fluids.

2. Description of the Prior Art

Functional fluids have been utilized in many different types of applications such as electronic coolants, diffusion pump fluids, lubricants, damping fluids, bases for greases, power transmission and hydraulic fluids, heat transfer fluids, heat pump fluids, refrigeration equipment fluids and as filter mediums for air-conditioning systems. Of these uses, hydraulic fluids intended for use in the hydraulic system of aircraft for operating various mechanisms and aircraft control systems must meet stringent functional and use requirements. One of the most important requirements for an aircraft hydraulic fluid is that the fluid be chemically stable to resist oxidative and thermal degradation which can result in the formation of acids and the corrosive attack of metals in contact with hydraulic fluid.

In order to control the degree of acid buildup during use of the fluid and inhibit corrosion of the components in the hydraulic system, it is conventional to add certain acid scavengers and/or corrosion inhibitors to the hydraulic fluid base stock.

Although a variety of compounds have been suggested for use as corrosion inhibitors, acid acceptors which act as proton acceptors and prevent the buildup of corrosive acids in the fluids when they undergo decomposition under prolonged use at high temperatures are generally preferred. A particularly preferred class of such materials comprises epoxy compounds, especially epoxidized naturally occurring materials such as epoxidized unsaturated glycerides including epoxidized soybean oil, epoxidized castor oil, epoxidized linseed oil, epoxidized fats and the like. Other suggested materials include epoxy esters such as butylepoxyacetoxystearate, glyceryl triepoxyacetoxystearate, isooctylepoxystearate, epoxidized isooctyl phthalate and the like. Also suggested are various alkyl and arylalkyl epoxides such as epoxy decane, epoxy hexadecane, epoxy octadecane, cyclododecane, and the like, and glyceryl and various glycidyl ethers such as phenyl glycidyl ether, glycidyl cyclohexyl ether, alkyl glycidyl ether, and the like.

More recently it has been suggested that a particular class of epoxy compounds, the 3,4-epoxycycloalkyl-3,4-epoxycycloalkyl carboxylates, are particularly useful as acid acceptors for hydraulic fluids and are more effective than the epoxy compounds used heretofore. A particularly preferred compound is 3,4-epoxycyclohexylmethyl-3,4-epoxycyclohexane carboxylate. These compounds are well known chemical entities which have been used as acid scavengers for chlorinated diphenyl dielectric fluids prior to their introduction as inhibitors for hydraulic fluids.

Although 3,4-epoxycycloalkyl-3,4-epoxycycloalkyl carboxylates are effective acid scavengers for common hydraulic fluid compositions, they have a disadvantage in that they cause resinous deposits to form around the fluid pump shaft at the point of seal. The formation of deposits is of particular concern in aircraft hydraulic systems which operate under pressure and where the deposits soon result in fluid leakage through the seal. Although the problem of shaft seal leakage is not serious from an aircraft operational point of view, it represents a sufficient nuisance that the aircraft industry and aircraft hydraulic fluid manufacturers have actively sought alternative acid acceptors which are as effective and efficient as the 3,4-epoxycyclohexylmethyl-3,4-epoxycyclohexane carboxylate but which do not have the deposit and leakage problem associated with this material.

It is accordingly an object of this invention to provide an acid acceptor effective to prevent acid buildup in functional fluid compositions. Another object of this invention is to provide an acid acceptor which can be used without adverse secondary effects in functional fluids which may also contain a polymeric V.I. improver. A further object of this invention is to provide functional fluid compositions which are resistant to thermal and oxidative degradation and which are suitable for use in aircraft hydraulic systems. It is a yet further object of this invention to provide an aircraft hydraulic fluid containing a polymeric V.I. improver and an epoxide acid acceptor which does not cause pump shaft seal leakage. Yet further objects will be apparent from the following description of the invention.

SUMMARY

Functional fluid compositions of this invention comprise a major amount of at least about 50 percent by weight of a base stock material selected from the group consisting of esters or amides of an acid of phosphorus, di- or tricarboxylic acid esters, esters of polyhydric compounds and mixtures thereof, from 0 to minor amounts of one or more other base stock materials or base stock modifiers, and from about 0.1 to 15 percent of a compound having the structure

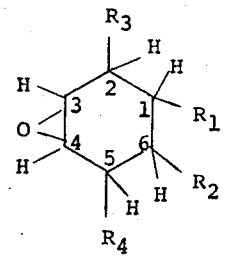

wherein $R_1$, $R_2$, $R_3$, and $R_4$ are individually hydrogen or an alkyl radical having 1 to 18 carbon atoms, provided at least one R is an alkyl group; preferably the alkyl groups contain 1 to 12 carbon atoms. A particularly preferred compound is methyl-3,4-epoxycyclohexane. The compositions may include polymeric V.I. improvers and other conventional additives and are particularly useful as aircraft hydraulic fluids.

DESCRIPTION OF PREFERRED EMBODIMENTS

The functional fluid compositions of the present invention comprise as the essential components a base stock material and an epoxy compound. The concentration of the epoxy compound in the functional fluid is adjusted according to the demands of the system and nature of the base stock being employed in order to provide compositions which contain sufficient amounts of epoxy material to inhibit acid buildup during normal operation. It has been found that the concentration of epoxy compound required to inhibit and control acid buildup in a particular base stock varies according to the composition of the base stock or blends of base stocks. It has generally been found that preferred additive levels of epoxy compounds are from 0.10 weight percent to 5.0 weight percent, although concentrations of 15 percent or higher are also effective and may be used. Thus, included in the present invention are functional fluid compositions comprising a base stock material and an epoxy material in a concentration sufficient to control and inhibit acid buildup in the base stock. The fluid compositions of this invention can be compounded in any manner known to those skilled in the art for incorporating an additive into a base stock, as for example by adding the epoxy compound to the base stock with stirring until a uniform fluid composition is obtained.

As described above, suitable epoxy materials include methyl-3,4-epoxycyclohexane
1,2-dimethyl-4,5-epoxycyclohexane
1,2,-3-trimethyl-4,5-epoxycyclohexane
1,2,3,-6-tetraethyl-4,5-epoxycyclohexane
1-methyl-2-ethyl-3,4-epoxycyclohexane
1,2,-di(-2-ethylhexyl)-3,4-epoxycyclohexane
butyl-3,4-epoxycyclohexane
octadecyl-3,4-epoxycyclohexane
1,2-didecyl-3,4-epoxycyclohexane
$C_{11}$ to $C_{14}$-alkyl-3,4-epoxycyclohexane
$C_6$ to $C_{10}$-alkyl-3,4-epoxycyclohexane
1,2-di($C_6$-$C_{10}$-alkyl)-4,5-epoxycyclohexane
1,2,3-6-tetra-($C_6$-$C_{10}$-alkyl)-4,5-epoxycyclohexane
1-($C_4$ to $C_8$ alkyl)-2-($C_6$ to $C_{10}$ alkyl)-4,5-epoxycyclohexane.

Particularly preferred epoxy materials include those wherein $R_3$ and $R_4$ are hydrogen and $R_1$ and $R_2$ are individually an alkyl group having 1 to 9 carbon atoms or hydrogen; provided that at least $R_1$ or $R_2$ is an alkyl group. Examples include:

1,2-dipropyl-4,5-epoxycyclohexane
1,2-dipentyl-4,5-epoxycyclohexane
1,2-dioctyl-4,5-epoxycyclohexane
1,2-diethyl-4,5-epoxycyclohexane
nonyl-3,4-epoxycyclohexane
hexyl-3,4-epoxycyclohexane
(2-ethylhexyl)-3,4-epoxycyclohexane
butyl-3,4-epoxycyclohexane
ethyl-3,4-epoxycyclohexane
pentyl-3,4-epoxycyclohexane
propyl-3,4-epoxycyclohexane.

These compounds may be prepared by those procedures well known in the art for preparing epoxy compounds, for example the procedures described in U.S. Pat. No. 3,187,018 which is incorporated herein by reference.

Cyclohexene or alkyl substituted cyclohexene can be used to prepare the epoxycyclohexanes of this invention. For example, alkyl substituted cyclohexene is epoxidized with hydrogen peroxide.

As mentioned, the base stock material which comprises at least about 50% by weight of the functional fluids of the present invention, is selected from the group consisting of esters and amides of an acid of phosphorus, di- or tricarboxylic acid esters, esters of polyhydro compounds, and mixtures thereof. These base stock materials and examples thereof are described in U.S. Pat. No. 3,723,320, the subject matter of which is incorporated herein by reference.

Hydrocarbon phosphates are preferred. Phosphorus ester base stocks include trialkyl phosphates, triaryl and/or alkyl substituted aryl phosphates and mixed aryl and/or substituted arylalkyl phosphates. With respect to the alkyl groups, it is preferred to have from about 2 to about 18 carbon atoms, more preferably from about 2 to about 12 carbon atoms and with respect to the aryl and substituted aryl groups, it is preferred to have from about 6 to about 16 carbon atoms and more preferably, from about 6 to about 12 carbon atoms.

Typical examples of preferred phosphates are dibutylphenyl phosphate, triphenyl phosphate, tricresyl phosphate, tributyl phosphate, tri-2-ethylhexyl phosphate, trioctyl phosphate, the phosphates described in U.S. Pat. No. 3,723,315 which is incorporated herein by reference, such as di(nonylphenyl) phenyl phosphate, di(cumylphenyl) phenyl phosphate, (cumylphenyl) (nonylphenyl) phenyl phosphate, and mixtures of the above phosphates such as mixtures of tributyl phosphate and tricresyl phosphate, mixtures of triphenyl phosphate and 2-ethylhexyl diphenyl phosphate, mixtures of cumylphenyl diphenyl phosphate, nonylphenyl diphenyl phosphate, 2-ethylhexyl diphenyl phosphate and triphenyl phosphate. A preferred mixture contains 45 to 65% triphenyl phosphate, 25 to 45% by weight of the reaction product of 1.5 to 2 moles of nonylphenol, 0.5 to 1 mole of cumylphenol, 6 to 7 moles of phenol with 3 moles of phosphorus oxychloride and 5 to 15% of 2-ethylhexyl diphenyl phosphate. All percentages are by weight based on the total weight of the mixture.

In addition to these base stock materials, the functional fluid may contain up to about 50 percent of one or more other base stock materials. Examples of these other base stock materials are given in U.S. Pat. No. 3,723,320. Although it is not permissible to employ these other base stock materials in major amounts in fluid compositions of the instant invention, they may be used singly or in combination as a minor component of the total base stock present in amounts of less than about 50 percent by weight.

In addition to the base stock materials and the monoepoxycyclohexyl compound, the fluids of the instant invention may also contain one or more base stock modifiers. As used herein "base stock modifier" means any material which when added to the base stock effects a determinable change in the chemical or physical properties of the base stock. Examples of typical classes of such modifiers which are widely used in formulating hydraulic and other functional fluids include dyes, pour point depressants, antioxidants, antifoam agents, viscosity index improvers such as polyalkyl acrylates, polyalkyl methacrylates, polycyclic polymers, polyurethanes, polyalkylene oxides and polyesters, lubricity agents and water.

The preferred polymeric viscosity index improvers which may be employed in the compositions of this invention are the polymers of alkyl esters of unsaturated monocarboxylic acids having the formula

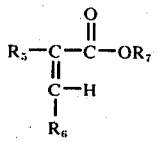

wherein $R_5$ and $R_6$ are each individually hydrogen or a $C_1$ to about $C_{10}$ alkyl group, and $R_7$ is a $C_1$ to about $C_{12}$ alkyl group. Illustration of the alkyl groups represented by $R_5$, $R_6$ and $R_7$ within their definitions as given above are for example methyl, ethyl, propyl, butyl, t-butyl, isopropyl, 2-ethylhexyl, hexyl, decyl, undecyl, dodecyl and the like. These polymers include, for example, poly(butylmethacrylates), poly(hexylmethacrylates), poly(octylacrylates), poly(dodecylacrylates) and polymers wherein the ester is a mixture of compounds obtained by esterifying the $\alpha$-$\beta$ unsaturated monocarboxylic acid with a mixture of monoalcohols containing from 1 to 12 carbon atoms. These and other "base stock modifiers" are described in U.S. Pat. No. 3,723,320.

In a preferred embodiment of the present invention the functional fluid compositions comprise at least about 50 percent by weight of a phosphate ester or mixture of phosphate esters represented by the structure

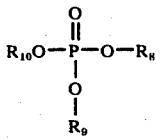

wherein $R_8$, $R_9$ and $R_{10}$ are hydrocarbon radicals selected from the group consisting of alkyl, alkoxyalkyl, aralkyl, aroxyalkyl, aryl, aroxyaryl, alkoxyaryl, alkaryl, and mixtures thereof and halogenated and alkyl-substituted members thereof having up to about 18 carbon atoms, and from about 0.1 to 15 percent by weight of an epoxy compound as hereinbefore defined. In addition to the phosphate ester and epoxy compound, these preferred fluid compositions can also contain certain additives as hereinbefore defined and can also contain minor amounts, e.g., less than about 50 percent by weight of one or more other base stock compositions as hereinbefore defined.

Particularly preferred functional fluid compositions comprise at least about 65 percent by weight of such phosphate esters and less than about 35 percent by weight of other materials including other base stocks and base stock modifiers, and even more preferably contain at least about 80 percent by weight of such phosphate esters and less than about 20 percent by weight of other materials. Particularly preferred phosphate esters for use in the compositions of this invention are dialkylaryl phosphates wherein the alkyl radicals have 1 to 18 carbon atoms, e.g., dibutylphenyl phosphate, and mixtures of trialkyl phosphate and triaryl phosphate such as 88/12 tributyl phosphate/tricresyl phosphate.

The invention will now be illustrated by the following Examples. All parts and percentages are by weight unless otherwise indicated.

EXAMPLE I

Preparation of Methyl-3,4-epoxycyclohexane

To a suitable reaction vessel was charged:

4-methylcyclohexene 50 gm (M.W. 96.17 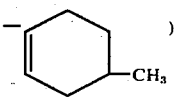 )

Ether 125 gm

To this was slowly added dropwise 116 gm of metachloroperbenzoic acid in 400 ml of methyl ether. The reaction vessel was kept in an ice bath to maintain the reaction temperature at 20° to 26°C. during the addition which took about 45 minutes. The reaction mixture was washed and dried. The product yield was 47.3 gm of which 99.2% was the desired cyclohexane. Test results are given in the following Table.

TABLE

| Test No. | Base Fluid | Percent Epoxide | Acid[1] Buildup | Shaft[2] Seal Leakage | Corrosion Rate, mg/cm² Mg | Al | Cd | Fe | Cu |
|---|---|---|---|---|---|---|---|---|---|
| 1 | A | 2.5 | >200 | 1/200.4 | +0.38 | +0.04 | −0.04 | +0.02 | −0.40 |

[1]Acid buildup, hours to 0.50 titratable acid number (TAN)

[2]Shaft seal leakage, drops of fluid/hours of test

Base Fluid A comprises 94.2% dibutylphenyl phosphate; 5.1% polyalkylmethacrylate polymer V.I. improver; 0.2% water.

In the preceding test, the stability of the fluid to oxidative and acid buildup was determined by maintaining the fluid at 275°F. and periodically titrating samples of the fluid to monitor the acid buildup. A titratable acid number (TAN) of 0.50 was taken as the end point, and the number of hours required for the fluid to reach this level of acid content was recorded as the acid buildup figure. Corrosion rates were determined and given as metal loss in mg/cm².

Shaft seal leakage data was obtained by circulating the fluid in a closed loop through a Type APL-10V-7B aircraft hydraulic pump operated at 3600 r.p.m. and at a fluid temperature of 225°F. and pressure of 30 psig. The shaft seal rotor was constructed of Type 440 stainless steel while the stator was of sintered bronze. The fluid leaking from around the pump shaft was collected and weighed and the data reported as grams collected/hours of test. The predetermined test period was 200 hours minimum unless significant leakage justified premature termination.

While this invention has been described with respect to various specific examples and embodiments, it is to be understood that the invention is not limited thereto and that it can be variously practiced within the scope of the following claims.

What is claimed is:

1. A functional fluid composition comprising

A. at least about 50 percent by weight of a base stock material selected from the group consisting of esters and amides of an acid of phosphorus, di- or tricarboxylic acid esters, esters of polyhydric compounds, and mixtures thereof, and B. from about 0.1 to 15 percent by weight of an epoxide compound represented by the structure

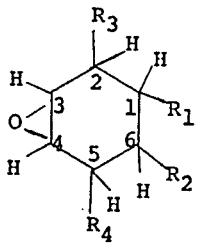

wherein $R_1$, $R_2$, $R_3$, and $R_4$ are individually an alkyl radical having from 1 to about 18 carbon atoms or hydrogen, provided that at least one R is an alkyl group.

2. A composition of claim 1 wherein $R_3$ and $R_4$ are hydrogen.

3. A composition of claim 2 wherein the base stock material is a phosphate ester represented by the structure

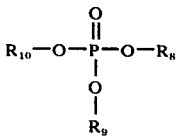

wherein $R_8$, $R_9$, and $R_{10}$ are hydrocarbon radicals selected from the group consisting of alkyl, alkoxyalkyl, aralkyl, aroxyalkyl, aryl, aroxyaryl, alkoxyaryl, alkaryl, and mixtures thereof and halogenated and alkyl-substituted members thereof having up to about 18 carbon atoms.

4. A composition of claim 3 wherein $R_{10}$ and $R_9$ are $C_{1-18}$ alkyl radicals and $R_8$ is a $C_{6-18}$ aryl radical.

5. A composition of claim 3 wherein the phosphate ester is dibutylphenylphosphate.

6. A composition of claim 5 wherein the epoxide compound is $C_{1-12}$ alkyl-3,4-epoxycyclohexane.

7. A composition of claim 3 wherein the phosphate ester is a mixture of tributyl phosphate and triaryl phosphate.

8. A composition of claim 7 wherein the epoxide compound is $C_{1-12}$ alkyl-3,4-epoxycyclohexane.

9. A functional fluid composition comprising a composition of claim 3 and from about 2 to 20 percent by weight of a viscosity index improver which is a polymer of an ester having the structure

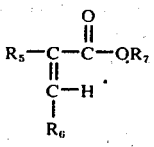

wherein $R_5$ and $R_6$ are each individually hydrogen or a $C_1$ to about $C_{10}$ alkyl group, and $R_7$ is a $C_1$ to about $C_{12}$ alkyl group.

10. A functional fluid composition comprising a composition of claim 3 and from about 2 to 20 percent by weight of a viscosity index improver which is a polymer of an alkylene oxide having a polymeric molecular weight of from about 1,500 to 4,500.

11. In a method of operating a hydraulic pressure device wherein a displacing force is transmitted to a displaceable member by means of a hydraulic fluid, the improvement which comprises employing as said fluid a composition of claim 1.

12. In a method of operating a hydraulic pressure device wherein a displacing force is transmitted to a displaceable member by means of a hydraulic fluid, the improvement which comprises employing as said fluid a composition of claim 4.

* * * * *